United States Patent [19]

Chandler et al.

[11] Patent Number: 4,594,587

[45] Date of Patent: Jun. 10, 1986

[54] CHARACTER ORIENTED RAM MAPPING SYSTEM AND METHOD THEREFOR

[75] Inventors: Gregg Chandler; Babu Rajaram, both of St. Joseph, Mich.

[73] Assignee: Zenith Electronics Corporation, Glenview, Ill.

[21] Appl. No.: 527,945

[22] Filed: Aug. 30, 1983

[51] Int. Cl.[4] ..... G09G 1/00

[52] U.S. Cl. ..... 340/750; 340/745; 340/748

[58] Field of Search ..... 340/748, 750, 798, 799, 340/721, 726, 745, 790

[56] References Cited

U.S. PATENT DOCUMENTS

| | | | |
|---|---|---|---|
| 3,577,142 | 5/1971 | McMillin | 178/26 A |
| 3,624,632 | 11/1971 | Ophir | 340/745 |
| 3,967,268 | 6/1976 | Roberts | 340/745 |
| 3,970,790 | 7/1976 | Guanella | 178/22.04 |
| 4,417,318 | 11/1983 | Hirahata et al. | 364/900 |
| 4,429,306 | 1/1984 | Macanley et al. | 340/790 |

*Primary Examiner*—Gerald L. Brigance

[57] ABSTRACT

Conventional bit-mapped address locations in a character oriented video random access memory (RAM) in which each character is represented by a bit mapping array comprised of ten lines each including eight pixels, or eight bits of information, in an X-Y matrix address organization are redefined in terms of the character and row address locations of a graphics oriented cathode ray tube controller for driving a video display. Groups of bits in the X-Y matrix address locations of the video RAM are shifted in a predetermined manner in generating a redefined, 1:1 mapping function addressing code which is provided to a cathode ray tube controller for driving the video display. A video RAM mapping module is provided for reorganizing the video RAM addresses and translating these addresses throughout the page of the video RAM in providing more efficient graphics mapping while retaining high resolution alphanumeric character video resolution. In one embodiment, a video display start bit is incremented by an 8-bit adder to provide for scrolling on a line-by-line basis without moving character bytes from one location to another in the video RAM.

10 Claims, 2 Drawing Figures x = HORIZONTAL BYTE INDEX (0, 127)
y = VERTICAL BYTE INDEX (0, 511)

CHARACTER ORIENTED RAM MAPPING SYSTEM AND METHOD THEREFOR

BACKGROUND OF THE INVENTION

This invention relates generally to the presentation of information on a video display and more specifically is directed to pixel/bit mapping on the faceplate of a video display for presenting alphanumeric character and graphics information thereon.

The inside face of a cathode ray tube (CRT) is coated with phosphor, or a similar light-emitting substance, in the form of individual pixels, or dots, which glow when struck by an electron beam. A complete image is generated on the CRT's screen, or faceplate, by scanning the screen with an electron beam generally in a left to right direction as viewed from the front of the video display in an individual line sequence where the electron beam is deflected downward one line at the end of one sweep to again provide another sweep line from left to right. Thus, when the movement of the electron beam across one horizontal scan line is complete, it drops down to the next horizontal scan line and sweeps across this line from left to right. When the electron beam scan reaches the bottom of the CRT's screen, the electron beam is deflected from the lower right hand corner of the screen to the upper left hand corner thereof in a vertical deflection period. During this interval the electron beam is "off" and the vertical deflection of the beam is thus not seen by the viewer.

When utilized in a computer terminal, the video display on the CRT is accomplished by a mapping process wherein memory bits representing the CRT's screen are stored in a random access memory (RAM). Each memory bit has a logical value of one or zero with each bit thus representing a light or dark spot at a particular location on the raster of the video display, depending on the bit's value. Alternatively, a group of bits may be used to represent a gray scale code. In addition, several video RAM's may be utilized in a multi-electron beam video display to provide presentation of color images on the CRT's screen.

In a typical computer terminal with a video display, each alphanumeric character may be thought of as occupying a rectangular "frame" on the CRT's screen. This "frame" may be defined by a rectangular matrix comprised of m by n pixels, or elemental dots. For example, a character "frame" may be 8 by 10 pixels. Within this frame there are $2^{80}$ possible patterns of pixels when each pixel may be on or off. Often, the full flexibility of displaying any of these patterns is not required. In such a case, 8 bits may be used to represent the pattern to be displayed in this frame. This means that only 256 of the potential $2^{80}$ frames may be displayed. This set of displayable patterns is termed the font. Once patterns to represent each of the displayable alphanumeric characters have been defined, the remaining patterns to be included within the font are chosen to facilitate "block-graphic" displays. Since only a very restricted, and usually rigid, subset of the total potential frames may be represented, the "block-graphics" rendered from such a terminal are somewhat inflexible. As has been stated, this is because not all of the potentially displayable patterns may be displayed. To solve this problem, each of the displayable pixels making up the previously described frame may be mapped into a bit of Random Access Memory (RAM). This means that 80 bits of RAM are now required to represent the previously described "frame", and in return, all $2^{80}$ patterns are displayable.

The video display system just described is generally termed "bit-mapped". This is because each bit of the screen is mapped into a bit of RAM. This lies in contrast to the first system which is generally termed as a "character generation" video system because only predefined patterns, or characters, are displayable. It is precisely the mapping of video RAM bits to screen pixels in a bit-mapped video system with which this invention is concerned.

The primary disadvantages of a bit-mapped video system such as that just described are increased cost and complexity. Whereas the former "character-generator" system (with a restricted font), used only 8 bits of RAM to represent the data to be displayed in a "frame", the bit-mapped system uses 80 bits. The increased cost and concomitant complexity has historically rendered such bit-mapped systems quite expensive. However, in the system herein described, the complexity has been significantly reduced by utilizing semiconductor devices readily available for the implementation of character generation systems in the implementation of the desired "bit-mapped" system. This reduces system complexity and cost, though not the amount of RAM required in such a system—the RAM size is generally determined by the number of pixels to be represented on the screen.

The additional cost and complexity attendant with a bit-mapped video system are not limited to hardware implementation issues. The software required to manipulate the data is more complex. In the character generation system, manipulating the 8 bits required to display a character is relatively simple as compared to the manipulation of the 80 bits required to represent a character in the discussed bit-mapped system. Approaching the performance of the much simpler character generator systems from a displayable character rate with a bit-mapped graphics system is difficult, and is closely tied to the mapping of the RAM bits to screen pixels. A "convenient" of such a system. The pixels must be organized conveniently for access in the groups of 80 as required in the display of alphanumeric characters. The pixels must also be organized conveniently for access individually as in the case of displaying a thin "pixel line" across the screen. The invention herein documented provides such a convenient mapping. It facilitates the efficient displaying of characters, as well as addressing individual pixels.

Thus, when this mapping system is used in conjunction with the discussed bit-mapped implementation using "character-generator" type devices, a cost effective, yet flexible, and efficient bit-mapped system is produced. The character "throughput" rates of this system more closely approximate those of the simpler system than they would if the mapping algorithm were not used. Thus, the primary goal/achievement of this invention is higher throughput, i.e., better performance in a more cost effective implementation.

Various attempts have been made in microcomputer terminals to decrease information processing time while simultaneously reducing system complexity and associated cost. For example, one solution is to limit the complexity of the tasks performed by the microcomputer. The number of individual operations required to perform the simpler tasks would be less and would, therefore, take less time. This solution is undesirable in that it would result in a severe limitation in the processing capability of the microcomputer and the entire system. Another approach to the processing time problem has been to increase the throughput of the microcomputer, i.e., to increase the size (e.g., number of bits) of the data word the microcomputer is capable of operating on. For example, if the microcomputer is designed to handle 8-bit data words (as most presently available microcomputers are), a microcomputer capable of handling 12- or 16-bit words is provided. As the word size handled by the microcomputer increases, the complexity, size and cost of the microcomputer also increase at a substantially faster rate. In addition, the present advantages of currently available large-scale, single-chip programmable microcomputers which are powerful, inexpensive, and easy-to-use devices would be lost by going to higher bit word capable machines.

Another problem inherent in a bit-mapping microcomputer controlled video display system relates to the differences between alphanumeric character presentation and video display graphics. As previously explained, alphanumeric characters are presented in a regular, repeating, sequential fashion as the electron beam raster scans the CRT's screen. However, graphics applications typically require the display of seemingly unrelated, widely displaced portions of the CRT's screen. The bit-map addressing in the video RAM in the latter application are substantially more intricate as is the handling of data in displaying graphics information. In addition to the additional complexities of data handling, video display of alphanumeric characters such as in word processing applications generally requires greater display resolution than the presentation of other types of graphics information. Heretofore this enhanced resolution has been available only in substantially more complex and expensive systems.

One approach to improving CRT character generation and display is described in U.S. Pat. No. 4,298,867 to Craig wherein the rise and fall times of an interpolated raster control signal are modified by a rise-time control circuit so as to be proportional to the width of a jagged edge of a character to be displayed. By thus controlling the rise and fall times of the raster control signal as the electron beam strikes the phosphor CRT's screen, gradual changes occur within a time that is proportional to the secant of the slope of the character edge, relative to vertical. This process creates the appearance of a smooth sloping edge when the character is ultimately displayed on the CRT's screen. U.S. Pat. No. 4,298,931 to Tachiuchi, et al., discloses a character pattern display system wherein a plurality of character store RAMs are operated by a central processing unit (CPU) and a display timing signal means. During one character display time, a first character store RAM is subjected to a read/write operation by the CPU. At this time, a second character store RAM is subjected to a read operation by a display timing signal from the display timing signal means and a third character store RAM is refreshed. These concurrent operations of the RAMs are sequentially switched for each character display time. While this system requires sophisticated timing circuitry and a large address memory capacity, it is asserted that this approach provides for the constant display of characters on the CRT's screen using currently available MOS LSI CPU's and RAM's.

OBJECTS OF THE INVENTION

Accordingly, it is an object of the present invention to provide an improved means and method for presenting alphanumeric character and graphic information on a video display.

It is another object of the present invention to optimize graphic mode throughput without significantly degrading alphanumeric character presentation on the video display of a microcomputer terminal.

Another object of the present invention is to utilize a character oriented cathode ray tube controller in a bit-mapped graphics application.

A further object of the present invention is to provide enhanced information processing, i.e., reduced processing times, increased information handling capacity, etc., in a microcomputer terminal incorporating a video display without the addition of more complex and expensive system components.

BRIEF DESCRIPTION OF THE DRAWINGS

The appended claims set forth those novel features believed characteristic of the invention. However, the invention itself as well as further objects and advantages thereof will best be understood by reference to the following detailed description of a preferred embodiment taken in conjunction with the accompanying drawings, in which:

DESCRIPTION OF THE PREFERRED EMBODIMENT

Figure 1:
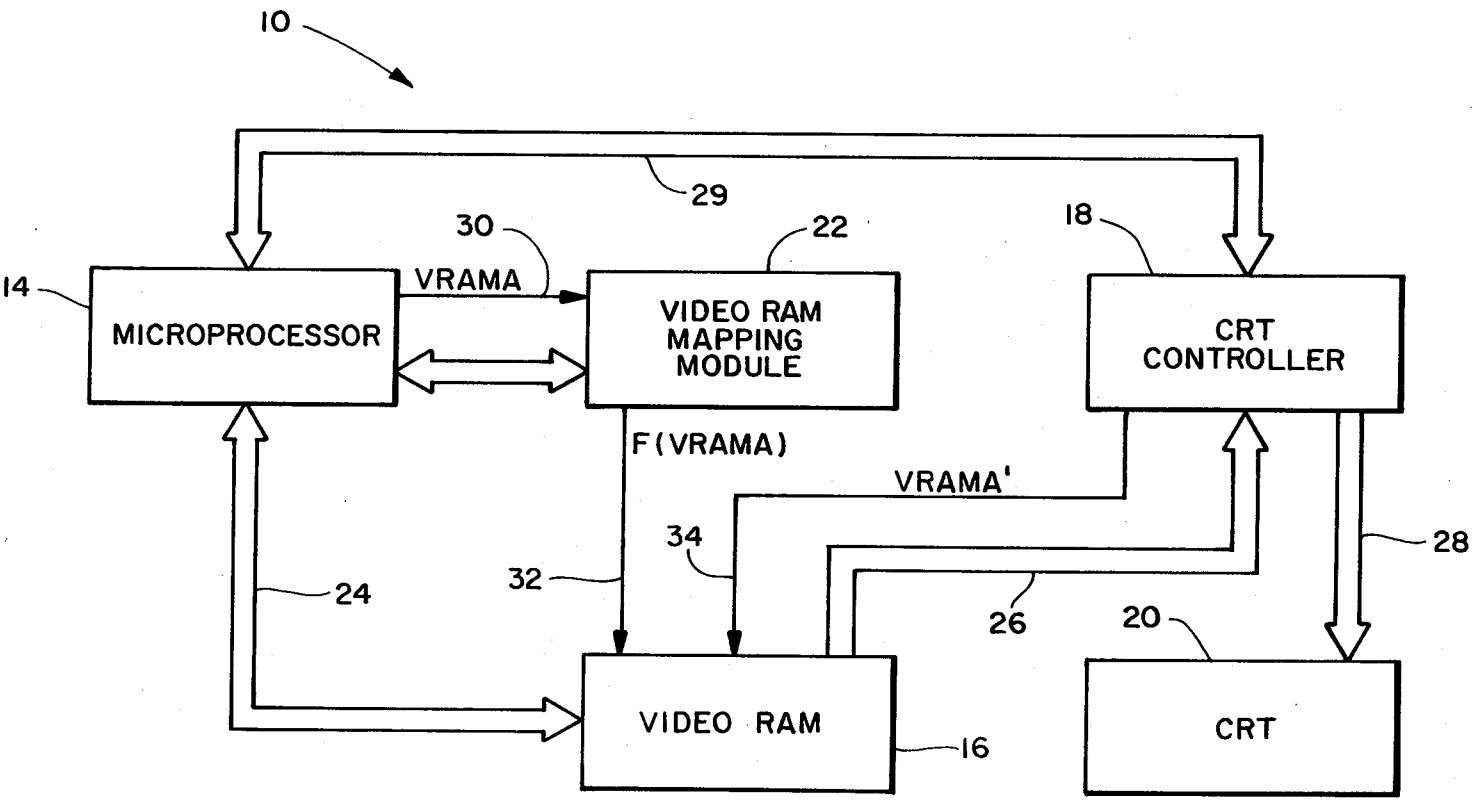
FIG. 1 is a simplified block diagram of a character oriented RAM mapping system in accordance with the present invention.

Referring to FIG. 1, there is shown a bit-mapped oriented RAM mapping system 10 in accordance with the preferred embodiment of the present invention. The simplified block diagram of FIG. 1 includes the major components of the system, i.e., a microprocessor 14, a video RAM 16, a CRT controller 18, a CRT 20, and a video RAM mapping module 22. The interconnections between coupled components shown in FIG. 1 are conventional in nature and generally include either bidirectional or unidirectional control and data buses 24, 26 and 28 and various address buses 30, 32 and 34.

In general, the video RAM 16 stores all of the bit-patterns to be displayed on the CRT 20. Some of these patterns represent character images, whereas others may represent graphic images. The microprocessor 14 determines which patterns are to be displayed on the CRT, and modifies the video RAM to appropriately reflect these patterns. These patterns may result from external data generated by devices such as keyboards, or may have been internally generated in response to a command such as that to draw a line between two points on the face of the CRT 20. Each addressed byte of video RAM represents 8 pixels (or dots), of information on the CRT, and as such, represents part of the pattern used to display a character on the CRT 20, or part of some graphic image. The display memory contained in the video RAM 16 is then sequentially accessed by using addresses provided by the CRT controller 18 and the digital patterns read from the video RAM 16 are converted into corresponding video signals representative of the selected character patterns by the CRT controller 18 in driving the CRT 20.

The video RAM 16 is comprised of a plurality of bytes, each of which represents 8 pixels on the CRT's screen. To display a pixel, the appropriate byte/bit combination in the video RAM 16 must be modified. The address of this byte provided by the microprocessor is designated VRAMA. In the present invention, the address generated for the video RAM 16 does not necessarily correspond to that generated by the CRT controller 18. It is the incompatibility between the addressing formats of the video RAM 16 and the CRT controller 18 that the present invention is intended to overcome.

The microprocessor utilized in a preferred embodiment of the present invention is the 16-bit HMOS 8088 microprocessor available from Intel Corporation of Santa Clara, Calif. This microprocessor includes an 8-bit data bus interface which can address up to a maximum of 64K input/output (I/O) registers and 1 megabyte of external memory. The 8088 microprocessor is conventional in design and operation and thus representative of the typical 16-bit or 8-bit microprocessor currently available. Thus, the present invention is not limited in its application to the use of the 8088 microprocessor, but will operate equally well with any conventional 8- or 16-bit microprocessor. The CRT controller 18 utilized in a preferred embodiment of the present invention is the MC6845 CRT controller available from Motorola Semiconductor Products, Inc., of Austin, Tex. The CRT controller 18 generates the signals necessary to interface the digital system comprised of microprocessor 14, video RAM 16 and the video RAM mapping module 22 to a raster scan CRT 20. The CRT controller 18 continuously updates the CRT's screen 60 times per second based upon the contents of the addressed locations in the video RAM 16. The CRT controller 18 generates a video RAM address VRAMA' and reads a byte representing 8 pixels on the CRT's screen. Once these pixels are displayed, the CRT controller 18 automatically, depending upon its initialization parameters, advances to the next byte describing the next group of pixels with this process continuing without interruption.

The control/data signals transmitted on line 29 connecting the microprocessor 14 and the CRT controller 18 specify such system parameters as CRT type, lines per screen to be displayed on the CRT, characters per line and interrupt generation during the vertical sync interval. From FIG. 1, it can be seen that control and data signals are provided between the video RAM 16 and both the microprocessor 14 and the CRT controller 18.

The pixels of the CRT 20 are addressed as shown in Table I, where all numbers are assumed to be decimal in form. Note that these addresses are arbitrarily chosen However, they do reflect convenience in manipulating data within video RAM 16 from the microprocessor's view-point. Since each byte represents 8 consecutive pixels of information in a horizontal row, it is convenient to simply refer to the addresses of the byte containing the sought pixel. Within this microprocessor, the fundamental unit of accessing RAM is the byte. Hence accessing any of the pixels within a particular byte necessarily involves accessing the entire byte. Conventionally, the pixel column is divided by 8, yielding the address of the byte within the line. Table II is a table representing the convenient addresses for the bytes of video RAM. In oonsidering Table II, note that the address of each RAM byte is composed of a row and column. This invention preserves this convenient organization.

The CRT controller 18 by design addresses video RAM 16 sequentially. That is, the byte of row 0 and column 0 is the first to be displayed. This is followed by the display of the byte in row 0 and column 1. This display proceeds through the last column of the line (column 79 here). Then, the next line (row 1) is "scanned"—or must be converted to a "linear" address space—i.e., one in which all of the bytes are stored sequentially. The two-dimensional array of bytes indexed by row and column must be converted to a one-dimensional array addressable by the processor. This conversion typically would involve multiplication, division, or extensive table look-up. Such operations generally consume considerable overhead considering the rates and frequencies at which they must be performed in a typical application. To this end, the addressing of Table III is proposed.

The reason that the addresses of Table III are computationally efficient lies in the design of typical microprocessors. The details of this conversion from the row-column address to the complex address are fully discussed later. To appreciate the complexities of the address which must be generated from these simple addresses, one must consider the implementation of the bit-mapped graphics system.

TABLE I

| PIXELS WITHIN ROW | | |
|---|---|---|
| Row 0 | 0,1,2, . . . , | 639 |
| Row 1 | 0,1,2, . . . , | 639 |
| " | " | " |
| Row 249 | 0,1,2, . . . , | 639 |

TABLE II

| BYTE WITHIN ROW | | |
|---|---|---|
| Row 0: | 0,1,2, . . . , | 79 |
| Row 1: | 0,1,2, . . . , | 79 |
| " | " | " |
| Row 249: | 0,1,2, . . . , | 79 |

TABLE III

| | | |
|---|---|---|
| Row 0: | 0,1,2, . . . , | 79 |
| Row 1: | 128,129,130, . . . , | 79+128 |
| " | " | " |
| Row N: | 0+N*128,1+N*128,2+N*128, . . . , | 79+N*128 |
| Row 249: | 0+249*128,1+249*128, . . . | 79+249*128 |

As has been previously stated, within each byte of the video RAM 16 the bits are mapped to individual pixels as shown in Table IV.

TABLE IV

| bit | 7 | 6 | 5 | 4 | 3 | 2 | 1 | 0 |
|---|---|---|---|---|---|---|---|---|
| | ↓ | ↓ | ↓ | ↓ | ↓ | ↓ | ↓ | ↓ |
| pixel | 0 | 1 | 2 | 3 | 4 | 5 | 6 | 7 |

From Table IV it can be seen that the value of the byte to display 0000000X, where "0" represents an unilluminated pixel and "X" represents an illuminated pixel, would be 1. Similarly a byte value of 85, or 55H in hexadecimal notation, would generate 0X0X0X0X. To display the pixel in the upper left hand corner of the CRT 20 with its surface represented by the matrix of Table III, 128, or 80H in hexadecimal notation, would be stored in address 0 of the video RAM 16.

When the electron beam moves across the CRT 20, the CRT controller 18 advances an internal register (not shown) which is used to point to the current display character. This address is referred to as the Refresh Memory Address ($MA_0$–$M_{11}$), which is used to determine the specific byte of video RAM 16 used to refresh the screen at any particular point in time. The other major register in the CRT controller 18 used in displaying characters on CRT 20 is the Row Address which is incremented for each consecutive scan line of the specified character. The 16-bit address utilized by the CRT controller 18 can be represented as:

| Refresh Memory Address | Row Address |
|---|---|
| $MA_{11}$–$MA_0$ | $R_3$–$R_0$ |

In the standard application of a CRT controller, the Row Addresss is used to select the scan lines with a specific font character and the byte value pointed to by the $MA_0$–$MA_{11}$ Refresh Memory Address is used to select a character within the font. In the present invention, these addresses are used to form the address of the next byte to be displayed on the screen rather than indexing through a font ROM. The bytes are read via RAM 16 and then shifted out from the CRT controller 18 to the CRT 20 one bit at a time. Thus, in proceeding from left to right, the first 12 bits ($MA_0$–$MA_{11}$) represent the Refresh Memory Address for locating the current display character and the last 4 bits ($R_0$–$R_3$) represent the Row Address of the character displayed.

The CRT controller operating parameters controlling the generation of the Refresh Memory and Row Addresses in the CRT controller 18, as shown above, are the characters per line, the scan lines per character, and the lines per screen on the CRT 20. The CRT controller 18 increments the Memory Refresh Address ($MA_{11}$–$MA_0$) from the first character address of the line to the last character address of the line for the first scan line of the character. The Row Address lines $R_3$–$R_0$ are then incremented. The Memory Refresh Address is then incremented once again from that same first character address to the final character address for the second scan line of the character. This is repeated until all scan lines for the character have been displayed.

Once all of the scan lines for a character have been sequenced through, the base address for the Memory Refresh Address ($MA_{11}$–$MA_0$) is advanced to the first character of the next line. This process is repeated until all lines have been displayed on the screen of the CRT, at which time the CRT 20 undergoes vertical retrace during which the electron beam is in the "off" position and no pixels on the screen of the CRT 20 are illuminated. The Memory Refresh Address is then reinitialized to its start address and the above-described process is repeated.

If the CRT controller 18 is programmed for 10 scan lines per character, 80 characters per line, and 25 lines per screen, as in a preferred embodiment of the present invention, the addresses generated by the CRT controller 18 for each given cluster of 8 pixels, which represent a byte of information in video RAM 16, are as shown in Table V.

TABLE V

| | | | |
|---|---|---|---|
| 0 | 16 | 32 | 1264 |
| 1 | 17 | 33 | 1265 |
| 2 | 18 | 34 | 1266 |
| 3 | 19 | 35 | 1267 |
| 4 | 20 | 36 | 1268 |
| 5 | 21 | 37 | 1269 |
| 6 | 22 | 38 | 1270 |

TABLE V-continued

| | | | |
|---|---|---|---|
| 7 | 23 | 39 | 1271 |
| 8 | 24 | 40 | 1272 |
| 9 | 25 | 41 | 1273 |
| 1280 | 1296 | | 2544 |
| 1281 | 1297 | | 2545 |
| 1282 | 1298 | | 2546 |
| \| | \| | \| | \| |
| 1289 | 1305 | | 2553 |
| 2560 | | | 3824 |
| \| | \| | \| | \| |
| 30720 | 30736 | | 31984 |
| \| | \| | \| | \| |
| 30729 | 30745 | | 31993 |

Table VI illustrates the addresses of various characters in the various lines as displayed on the CRT 20 by the CRT control 18.

TABLE VI

| | | | | |
|---|---|---|---|---|
| 0*16 | 1*16 | 2*16 | ... | 79*16 |
| 0*16+1 | 1*16+1 | 2*16+1 | ... | 79*16+1 |
| 0*16+2 | 1*16+2 | 2*16+2 | ... | 79*16+2 |
| 0*16+3 | 1*16+3 | 2*16+3 | ... | 79*16+3 |
| 0*16+4 | 1*16+4 | 2*16+4 | ... | 79*16+4 |
| 0*16+5 | 1*16+5 | 2*16+5 | ... | 79*16+5 |
| 0*16+6 | 1*16+6 | 2*16+6 | ... | 79*16+6 |
| 0*16+7 | 1*16+7 | 2*16+7 | ... | 79*16+7 |
| 0*16+8 | 1*16+8 | 2*16+8 | ... | 79*16+8 |
| 0*16+9 | 1*16+9 | 2*16+9 | ... | 79*16+9 |

In general, the address of byte "c", scan line "s" and row "r" would be expressed as:

$r*80+c*16+s$ row r, $0 \leqq r \leqq 24$ scanline s, $0 \leqq s \leqq 9$ character c, $0 \leqq c \leqq 79$ Referring to the addresses shown in Tables III and V, it can be seen that there is an inconsistency between the mapping function of the video RAM 16 (Table III) and that of the CRT controller 18 (Table V). This inconsistency is resolved by the video RAM mapping module 22 as described in detail below. Briefly, the video RAM mapping module 22 translates the address specified in the notational convention of the video RAM to the address generated by the CRT controller 18 and provided thereto from the video RAM 16. The former addresses conforming with notational convention were chosen for convenience and optimum software design, while the latter addresses were stipulated by the design and operation of the CRT controller 18. In a typical application, the CRT controller 18 will be programmed to display either 10 or 16 scan lines per character on the CRT 20.

As previously described, the video RAM 16 may be accessed in one of two ways, either from the CRT controller 18 or from the microprocessor 14. As previously shown, the addresses generated by the CRT controller 18 for bytes of video RAM do not correspond to those specified in the notational convention utilized in video RAM addressing by the microprocessor 14. The video RAM mapping module 22 is designed to reconcile this difference in addressing formats between the video RAM 16 and the CRT controller 18. By reconciling these differences, the video RAM mapping module 22 optimizes graphic mode throughput without significantly degrading the alphanumeric character performance of the CRT 20.

One of the most crucial elements to the computer engineer and/or programmer in plotting an arbitrary pixel on the screen of the CRT is the computation of the address specifying the byte representing the desired pixel. Given the X (horizontal) and Y (vertical) coordinates of the pixel, the byte defined in the previously indicated notational convention utilized by the microprocessor 14 and video RAM 16 which contains the bit representing the pixel must be modified. To compute the byte address specifying a pixel, it must be remembered that there are 8 pixels per byte in a byte of video RAM. The byte index in a line is the X coordinate divided by 8 (all arithmetic here is assumed to be integer). The remainder from this division operation determines which pixel within the byte is to be modified. Since 8 is a power of 2, this computation may be accomplished with simple shifting and masking operations thus avoiding the necessarily slow arithmetic computations.

Figure 2:
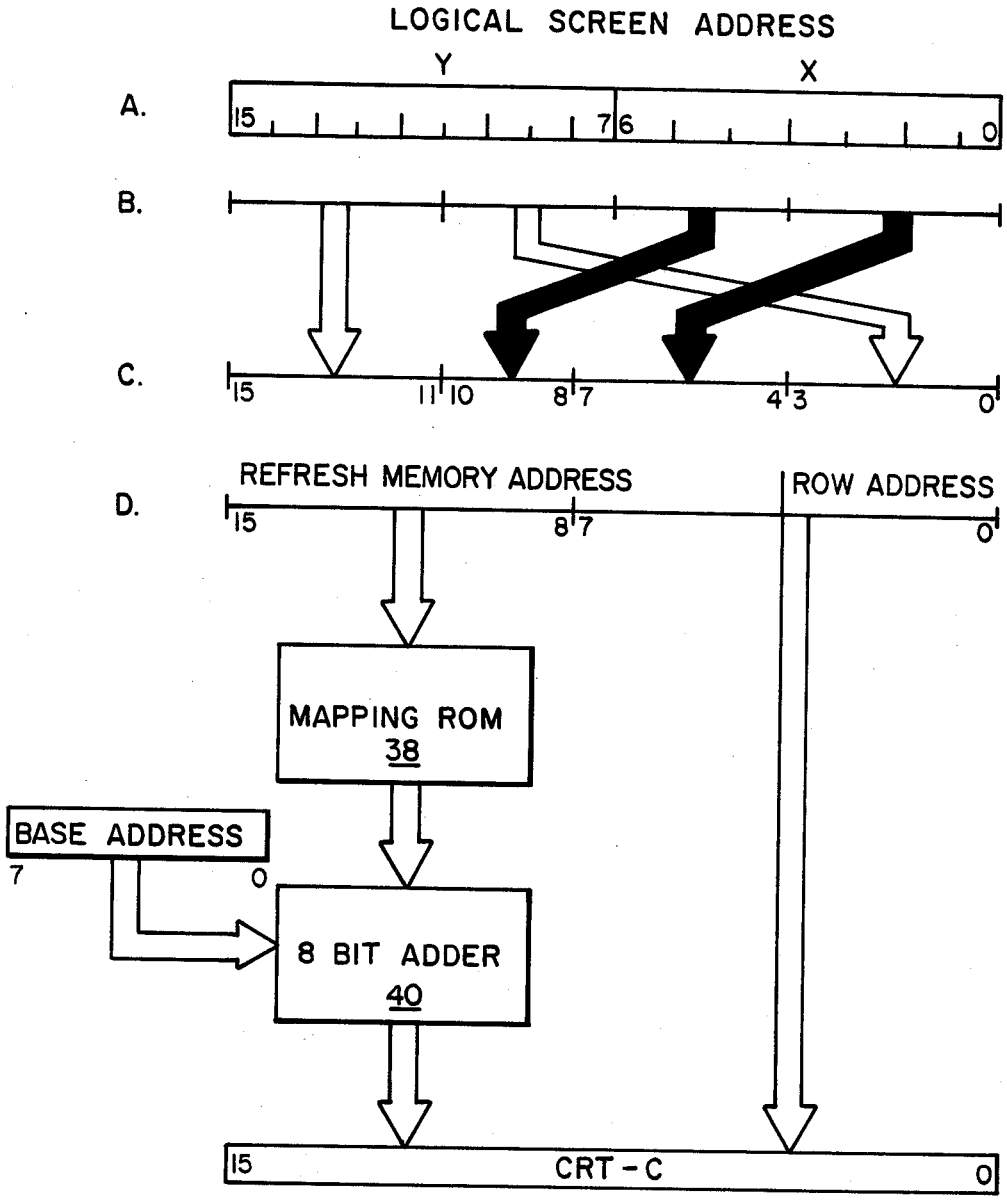
FIG. 2 shows the processing of a video RAM byte address by the video RAM mapping module in accordance with the present invention.

Referring to FIG. 2, there is shown the operation performed by the video RAM mapping module 22 upon the logical screen address byte of the video RAM 16. The logical screen address in the video RAM 16 is shown in the upper portion of FIG. 2, where the 7 lower bits (6–0) represent the X coordinate of the video RAM byte while the high order bits (15–7) represent the Y coordinate of the video RAM byte. The logical screen address of the video RAM shown at the top of FIG. 2 is in hexadecimal notation. Proceeding from top to bottom in FIG. 2, it can be seen that the address for the video RAM byte may be specified by shifting the Y coordinate left seven places, which is the equivalent of multiplying by 128 and logically ORing it with the previously computed X coordinate. The X coordinate is computed by saving the low three bits of the X address for use in the computation of a pixel mask (explained below) and then shifting the X coordinate right three places. This is the equivalent of dividing the logical screen address by 8. The resulting address is then provided to the video RAM mapping module 22. This operation and its advantages are described in detail in the following paragraphs.

Basically, two operations are performed by the RAM mapping module 22. The first function reorganizes the video RAM addresses, while the second "translates" these addresses throughout the page of video RAM. The address translation performed by the video RAM module 22 is an example of a "1-to-1", or an "onto" function. The range and domains of this translation function are $$A=\{n \mid 0 \leqq n < 64*1024\}.$$

The set of all values for n is such that 0 is less than or equal to n, and n is less than 64*1024. This restricts n to a 16-bit integer.

The domain is a set of arguments to the function. These are referred to as VRAMA in FIG. 1. The range is shown as F(VRAMA) and is a set of addresses over which the values of the video RAM mapping module 22 will range over all values in the domain. Because each value of the range is generated by a unique value of the domain, the function F is said to be 1:1, that is, no two values of a domain generate the same output value within the range. Because the image of VRAMA under this function F is F(VRAMA)=A, i.e., the set of values of F (VRAMA) is equal to A, the function is said to be "onto". This means that each element of the domain defines a unique element of the range. These properties of F(VRAMA) insure that each input address generates a unique output address. Thus, the video RAM mapping module 22 performs an address "scrambling" function.

Referring to FIG. 2 and Table VII, it can be seen that once the row and line indices of the video RAM byte address are computed, the row address which is represented by bits 6–0 is shifted left seven places, and OR'ed with the horizontal byte index represented by bits 15–7 of the logical screen address yielding the "logical" byte address for the so specified byte of video RAM as shown in line C of FIG. 2.

TABLE VII

| INPUTS | | | OUTPUTS | |
|---|---|---|---|---|
| 00000:000 | 0,0 | 00H | 00H | 0,0 |
| 00000:001 | 0,1 | 01H | 01H | 0,1 |
| 00000:010 | 0,2 | 02H | 02H | 0,2 |
| 00000:011 | 0,3 | 03H | 03H | 0,3 |
| 00000:100 | 0,4 | 04H | 04H | 0,4 |
| 00001:000 | 1,0 | 08H | 05H | 0,5 |
| 00001:001 | 1,1 | 09H | 06H | 0,6 |
| 00001:010 | 1,2 | 0AH | 07H | 0,7 |
| 00001:011 | 1,3 | OBH | 08H | 1,0 |
| 00001:100 | 1,4 | OCH | 09H | 1,1 |
| 00010:000 | 2,0 | 10H | 0AH | 1,2 |
| 00010:001 | 2,1 | 11H | OBH | 1,3 |
| 00010:010 | 2,2 | 12H | OCH | 1,4 |
| 00010:011 | 2,3 | 13H | ODH | 1,5 |
| 00010:100 | 2,4 | 14H | OEH | 1,6 |
| 00011:000 | 3,0 | 18H | OFH | 1,7 |

TABLE IX

| | VIDEO RAM MAPPING MODULE ROM CONTENTS | | | | | | | | | | | | | | | |
|---|---|---|---|---|---|---|---|---|---|---|---|---|---|---|---|---|
| Addr | 00 | 01 | 02 | 03 | 04 | 05 | 06 | 07 | 08 | 09 | 0A | 0B | 0C | 0D | 0E | 0F |
| 0000 | 00 | 01 | 02 | 03 | 04 | A0 | A1 | A2 | 05 | 06 | 07 | 08 | 09 | A3 | A4 | A5 |
| 0010 | 0A | OB | OC | OD | OE | A6 | A7 | A8 | OF | 10 | 11 | 12 | 13 | A9 | AA | AB |
| 0020 | 14 | 15 | 16 | 17 | 18 | AC | AD | AE | 19 | 1A | 1B | 1C | 1D | AF | BO | B1 |
| 0030 | 1E | 1F | 20 | 21 | 22 | B2 | B3 | B4 | 23 | 24 | 25 | 26 | 27 | B5 | B6 | B7 |
| 0040 | 28 | 29 | 2A | 2B | 2C | B8 | B9 | BA | 2D | 2E | 2F | 30 | 31 | BB | BC | BD |
| 0050 | 32 | 33 | 34 | 35 | 36 | BE | BF | CO | 37 | 38 | 39 | 3A | 3B | C1 | C2 | C3 |
| 0060 | 3C | 3D | 3E | 3F | 40 | C4 | C5 | C6 | 41 | 42 | 43 | 44 | 45 | C7 | C8 | C9 |
| 0070 | 46 | 47 | 48 | 49 | 4A | CA | CB | CC | 4B | 4C | 4D | 4E | 4F | CD | CE | CF |
| 0080 | 50 | 51 | 52 | 53 | 54 | DO | D1 | D2 | 55 | 56 | 57 | 58 | 59 | D3 | D4 | D5 |
| 0090 | 5A | 5B | 5C | 5D | 5E | D6 | D7 | D8 | 5F | 60 | 61 | 62 | 63 | D9 | DA | DB |
| 00A0 | 64 | 65 | 66 | 67 | 68 | DC | DD | DE | 69 | 6A | 6B | 6C | 6D | DF | EO | E1 |
| 00B0 | 6E | 6F | 70 | 71 | 72 | E2 | E3 | E4 | 73 | 74 | 75 | 76 | 77 | E5 | E6 | E7 |
| 00C0 | 78 | 79 | 7A | 7B | 7C | E8 | E9 | EA | 7D | 7E | 7F | 80 | 81 | EB | EC | ED |
| 00D0 | 82 | 83 | 84 | 85 | 86 | EE | EF | F0 | 87 | 88 | 89 | 8A | 8B | F1 | F2 | F3 |
| 00E0 | 8C | 8D | 8E | 8F | 90 | F4 | F5 | F6 | 91 | 92 | 93 | 94 | 95 | F7 | F8 | F9 |

TABLE IX-continued

| | VIDEO RAM MAPPING MODULE ROM CONTENTS | | | | | | | | | | | | | | | |
|---|---|---|---|---|---|---|---|---|---|---|---|---|---|---|---|---|
| Addr | 00 | 01 | 02 | 03 | 04 | 05 | 06 | 07 | 08 | 09 | 0A | 0B | 0C | 0D | 0E | 0F |
| 00F0 | 96 | 97 | 98 | 99 | 9A | FA | FB | FC | 9B | 9C | 9D | 9E | 9F | FD | FE | FF |

The first step in the reorganization of the video RAM address lines performed by the video RAM module 22 is the shifting of the X coordinate (horizontal byte index) lines left by 4 bits as shown in lines B and C of FIG. 2. This effectively multiplies the X coordinate value by 16 in terms of hexadecimal arithmetic operations. The X coordinate is then divided into two components which are subsequently treated differently in the bit manipulation performed by the video RAM mapping module 20. Since the number of bytes per line is 80, the low 4 bits of X should range from 0 to 15 five times. Because 80 is an integral multiple of 16, they do so evenly. The high 3 bits of the X coordinate range from 0 through 4, inclusively, for each line of bytes. Table VII indicates that consecutive bytes along a scan line of video RAM are consecutive integral multiples of 16 plus the scan line within the character index. By shifting the low order 4 bits of the Y-coordinate (the vertical coordinate, i.e., the scan line number) into the low order 4 bits of the output address just vacated by shifting the X coordinate to the left, the "scan line within character" component of the video RAM address is effectively added in as generated by the CRT controller 18.

Referring to Table VII, it can be seen that the high address byte represented by bits 11–8 and designating the Y coordinate does not sequence in a continuous manner. Thus, discontinuities are evident after every fifth address byte. As sequential horizontal byte addresses are generated for each of the scan lines, the values being generated by the high byte as provided to the mapping ROM 38 of the video RAM mapping module 22 are shown in Table VII.

It can be seen by comparing the inputs to and the outputs from the mapping ROM 38, that one steadily increasing (monotonic) sequence of addresses is converted into a more compact sequence of similar monotonic addresses in which the discontinuities in the former are eliminated in the latter. The mapping ROM 38 takes the data value presented at its input address, and outputs the 8-bit value found corresponding to its internal address. In this way, the "holes", or discontinuities, in the logical address space are squeezed out of the mapping output space. Shown in Table VIII are several examples of representative conversions from the conventional address notation format to the addresses generated by the CRT controller 18 in accessing the video RAM 16. The address designating the VRAMA address and the F(VRAMA) value are in hexadecimal notation.

TABLE VIII

| y(row index) | x(byte index) | VRAMA' address | F(VRAMA') |
|---|---|---|---|
| 0 | 0 | 0000H | 0000H |
| 0 | 1 | 0001H | 0010H |
| 0 | 2 | 0002H | 0020H |
| 0 | 79 | 004FH | 04F0H |
| 1 | 0 | 0080H | 0001H |
| 1 | 1 | 0081H | 0011H |
| 1 | 2 | 0082H | 0021H |
| 4 | 0 | 0200H | 0004H |
| 15 | 0 | 0780H | 000FH |
| 15 | 79 | 07CFH | 04FFH |

TABLE VIII-continued

| y(row index) | x(byte index) | VRAMA' address | F(VRAMA') |
|---|---|---|---|
| 16 | 0 | 0800H | 0500H |

Referring to TAble IX, it can be seen how the sequential "logical" byte address holes are filled to provide a continuous mapping function for the CRT controller 18. Table IX illustrates the address output based on the value of the input. For example, an input byte value of 23H (where H represents hexadecimal notation) will result in an output mapping value of 17H. The contents of Table IX also illustrate that once all of the legal input addresses have been assigned to their corresponding sequential output addresses, the remainder of the physical or CRT controller addresses are assigned sequentially to the "logical holes". T,0260

For example, since 05H is the first illegal value for a byte of the logical address, it is assigned the address of the first illegal CRT controller address for a mapping array comprised of 512 lines of 80 bytes each. Referring to Table IX, it can be seen that the illegal values for the logical address bytes are assigned sequentially in columns 5–7 and D–F and that the legal byte addresses are assigned in columns 0–4 and 8–C. It should be noted that a similar mapping ROM could be generated for any screen requiring some integral multiple of 16 bytes of video RAM horizontally, e.g., 96 or 120 bytes. To extend the mapping beyond 128 bytes would require extending the address specification or reducing the vertical resolution. To obtain mutually exclusive bit fields, these maximum values should be in terms of powers of 2. Thus, it can be seen that the present invention is not limited to a memory array matrix comprised of 512 lines of 80 bytes each but would operate equally as well for any CRT screen format comprised of an integral multiple of 16 bytes of video RAM for each horizontal scan line.

The invention as thus far described has been directed to a bit-mapped video implementation wherein a single video RAM 16 is utilized for displaying information on the CRT 20. This implementation represents a monochromatic, or black and white, display. To provide color capability, a separate plane, or video RAM array 16, for each of the "primary" video colors is used. The primary or fundamental video colors from which all others are derived are red, green and blue. One RAM array plane for each primary color is provided with all of the bytes of each of the RAMs describing a particular color organized sequentially in 64K byte pages of RAM. Thus, the pixel illuminated on the screen of the CRT is essentially composed of three superimposed pixels, one in each color plane. Since each of these three color pixels may be on or off, $2^3+8$ possible colors, including black wherein no pixels are illuminated, are available. These pixel combinations provide all possible colors. Conventional techniques could be utilized in integrating two additional video RAMs 16 in the system shown in FIG. 1 to provide a color capability for the CRT 20. Since this does not form a part of the present invention, this aspect of the invention will not be described in greater detail.

As described above, the full address generated and output by the mapping ROM 38 reorganizes the conventional mapping notation provided to the CRT controller 18. Scrolling is an obviously desirable feature in a video display, particularly in a word processing application for advancing text as desired for review, correction, etc. Scrolling the video display in the present invention is accomplished by incrementing the previously referred to start address in the upper left-hand corner of the video display. By adding 16*80=1280 bytes to the start address, the CRT controller 18 begins refreshing the screen from what would normally be the second line, but displaying these characters on the first line. If the CRT controller parameters have not been changed, an additional line will be displayed at the bottom of the CRT's screen to replace the line lost at the top, thus effectively scrolling the screen by the currently programmed number of scan lines per character. Unless the new line appearing at the bottom of the screen is zeroed before it is displayed, uninitialized data will be displayed. Once the start address is advanced, the data representing the line on the CRT's screen is in a different physical address. It is now located where the old representation for line 2 was present. Thus, the data itself in the CRT controller 18 does not move. The data representing the last line is in a scrambled area as shown in FIG. 2 where the new boundaries are shown once the start address is advanced. Because the data representing the last line is present in a scrambled data area, an 8-bit adder 40 is utilized to translate the physical addresses as shown in FIG. 2. By thus translating the physical address, it is possible to move the mapping function along so that it operates on consecutive "lines" of the video RAM 16.

Thus, once the CRT controller start address has been advanced and the value to be added to the logical address has been incremented by the number of bytes in a line representation, the data formerly representing line 2, now representing line 1, appears logically where the data representing line 1 formerly was, even though it has not been moved in the scrolling of the CRT controller 18. When the adder 40 is correctly initialized and maintained, the bytes representing line 25 are always in the same logical address. This frees the software routines from maintaining a pointer and indexing into the screen data based on the start address.

The value added to the address by means of the 8-bit adder 40 will always be a multiple of 80*16=5*16*16=5*256. In the implementation, adding n*(5*256) to the address is equivalent to adding n*5 to the next higher order byte of the address because multiplication by 256 is equivalent to shifting left by 8 bits. This is based on the assumption that the start address will always be a multiple of 80*16. If the start address is initialized to zero, then subsequent scrolling operations can maintain it as a multiple of 16*80.

There has thus been shown a video RAM mapping arrangement which reduces the complexity of data handling in a microcomputer-driven video display system and enhances graphic throughput. A video RAM mapping module reorganizes the video RAM addresses and translates these addresses throughout the page of the video RAM in providing more efficient graphics mapping while retaining high resolution alphanumeric character video resolution.

While particular embodiments of the present invention have been shown and described, it will be apparent to those skilled in the art that changes and modifications may be made therein without departing from the invention in its broader aspects. The aim in the appended claims, therefore, is to cover all such changes and modifications as fall within the true spirit and scope of the invention.

We claim:

1. In a video display system including a raster-scanned video display unit, a video display processor, a digital data memory coupled to said video display processor and responsive to output signals therefrom, said digital data memory including a first plurality of addressable memory locations for generating a first digital X-Y matrix, bit-mapping address signal defined by a plurality of locations each containing a pixel data bit and including m low order bits and n higher order bits representing the column and row coordinates, respectively, of a given location on said video display unit, and a video display unit controller coupling said video display processor and said digital data memory to said video display unit for presenting video information thereon, said video display unit controller having a second plurality of addressable memory locations therein each representing a given location on said video display unit and responsive to a second address signal comprised of x higher order bits representing a given position along a scan line on said video display unit and y lower order bits representing a given scan line on said video display unit, wherein said first and second address signals are represented in binary form to the base A, where A is a multiple of 2 and $$m+n=X+Y,$$

and one scan line of said video display unit is comprised of A bytes of video information, a method for converting said first address signal to said second address signal for driving said video display unit controller comprising:

shifting the m low order bits of said first address signal toward the higher order bits therein y data bit locations;

shiiting the y lowest order bits of said n higher order bits of said first address signal toward the lower order bits therein m data bit locations, in generating a first intermediate address signal having $$(n-y)+(m=y)$$

higher order bits and a plurality of low order bits;

converting the higher order bits of said first intermediate address signal to a continuous mapping function in generating a second intermediate address signal, whereby a continuous, 1:1 correlation exists between the respective locations on said video display unit represented by said first and second address signals; and providing said second intermediate address signal to said video display unit controller for presenting video information on said video display unit in terms of said X-Y matrix, bit mapping address signal.

2. The method of claim 1 wherein said first and second addreqs signals are expressed in hexadecimal binary notation with A=16 and wherein:

m=7, n=9,
x=12, and
y=4.

3. The method of claim 1 wherein the $$(n-y)+(m-y)$$

higher order bits of said second intermediate address signal represent the row coordinates and said low order bits thereof represent the column coordinates of a given location on said video display unit.

4. The method of claim 3 further including adding a predetermined value to the $$(n-y)+(m-y)$$

higher order bits of said first intermediate address signal during a vertical retrace interval of said video display unit for sequential displacing upward on said video display unit the contents of each scan line thereof, said predetermined value representing the number of scan lines displaced upward during each vertical retrace interval.

5. The method of claim 4 wherein the contents of the second plurality of addressable locations in said video display unit controller accessed by said second intermediate address signal are not transferred to other addressable locations in said video display unit controller when the contents of each scan line on said video display unit are sequentially displaced upward.

6. The method of claim 1 wherein said first address signal is adapted for a first mode of operation of said video display system wherein graphics information is displayed on said video display unit and said second address signal is adapted for a second mode of operation of said video display system wherein alphanumeric characters are displayed on said video display unit.

7. The method of claim 1 wherein the step of converting the higher order bits of said first intermediate address signal includes storing in a data memory having a plurality of addressable locations a plurality of digital data words corresponding to a continuum of values of said second intermediate address signal and selectively reading said digital data words therefrom in response to first intermediate address words provided thereto.

8. The method of claim 1 wherein the higher order bits of said first and second intermediate address signals represent respective first and second monotonically increasing sequences of address locations wherein said first monotonically increasing sequence is more compact than said second monotonically increasing sequence and said second monotonically increasing sequence is continuous.

9. In a video display system including a raster-scanned video display unit, a video display processor responsive to user-initiated input commands for generating an output signal in response thereto, a first digital data memory coupled to said video display processor and having stored therein a first plurality of digital code elements in an addressable X-Y array, each of said first plurality of digital code elements representing a particular location on said video display unit for generating in response to said output signal a first X-Y matrix, bit-mapping address signal defined by a plurality of locations each containing a pixel data bit and including m low order bits and n higher order bits representing the column and row coordinates, respectively, of said location on said video display unit, and a video display unit controller coupling said video display processor and said digital data memory to said video display unit for presenting video information thereon, said video display unit controller having a second plurality of digital code elements therein each representing a given location on said video display unit and responsive to a second address signal comprised of x higher order bits representing a given position along a scan line on said video display unit and y lower order bits representing a given scan line on said video display unit, wherein said first and second address signals are represented in binary form to the base A, where A is a multiple of 2 and $m+n=X+Y$, and one scan line of said video display unit is comprised of A bytes of video information, an address signal bit mapping system comprising:

first bit shifting means coupled to said video display processor and said first digital data memory for shifting the m low order bits of said first address signal toward the higher order bits therein y bit locations;

second bit shifting means coupled to said video display processor and said first digital data memory for shifting the y lowest order bits of said n higher order bits of said first address signal toward the lower order bits therein m bit locations, in generating a first intermediate address signal having (n−y)+(m−y) higher order bits and a plurality of low order bits;

bit mapping conversion means coupling said video display processor and said first digital data memory for converting the higher order bits of said first intermediate address signal to a continuous mapping function in generating a second intermediate address signal, whereby a continuous, 1:1 correlation exists between the respective locations on said video display unit represented by said first and second address signals and providing said second intermediate address signal to said video display unit controller for presenting video information on said video display unit in terms of said X-Y matrix, bit mapping address signal;

wherein said bit mapping conversion means includes a read only memory (ROM) having a plurality of addressable locations, each of said addressable locations containing a digital mapping word for generating said continuous mapping function in providing said second intermediate address signal to said video display controller in response to said first address signal provided thereto.

10. The system of claim 9 further including adding means coupled to said video display processor and said first digital data memory for adding a predetermined value to the $$(n-y)+(m-y)$$

high order bits of the bit-shifted first address signal during a vertical retrace interval of said video display unit for sequentially displacing upward on said video display unit the contents of each scan line thereof, wherein said predetermined value is a multiple of the bit length of a single scan line on said video display unit.

* * * * *